US005735956A

United States Patent [19]

Ueberschaer et al.

[11] Patent Number: 5,735,956

[45] Date of Patent: Apr. 7, 1998

[54] APPLICATOR FOR COATING A TRAVELING FIBER WEB

[75] Inventors: Manfred Ueberschaer, Nattheim; Martin Kustermann; Stefan Reich, both of Heidenheim, all of Germany

[73] Assignee: Voith Sulzer Papiermaschinen GmbH, Heidenheim, Germany

[21] Appl. No.: 634,586

[22] Filed: Apr. 18, 1996

[30] Foreign Application Priority Data

Apr. 20, 1995 [DE] Germany ..... 295 06 731.4

[51] Int. Cl.[6] ..... B05C 5/00

[52] U.S. Cl. ..... 118/410; 118/413; 118/419; 118/123; 118/126

[58] Field of Search ..... 118/118, 119, 118/123, 126, 410, 413, 419; 427/356

[56] References Cited

U.S. PATENT DOCUMENTS

| | | | |
|---|---|---|---|
| 4,688,516 | 8/1987 | Sommer | 118/413 |
| 4,870,920 | 10/1989 | Kageyama et al. | 118/120 |
| 5,103,759 | 4/1992 | Henseler et al. | 118/118 |

FOREIGN PATENT DOCUMENTS

| | | |
|---|---|---|
| 92 06 837.5 | 9/1992 | Germany . |
| 42 05 993 | 2/1993 | Germany . |
| 41 39 105 | 6/1993 | Germany . |
| 43 37 386 | 5/1994 | Germany . |
| 2 252 926 | 8/1992 | United Kingdom . |

OTHER PUBLICATIONS

"Erste Erfahrungen mit Neuentwicklungen von Auftrag–ung Dosiersystemen—Hydro–Bar und Jetcoat", Wochenblatt für Papierfabrikation, 23/24, 1983, pp. 875–885.

*Primary Examiner*—Laura Edwards
*Attorney, Agent, or Firm*—Taylor & Associates, P.C.

[57] ABSTRACT

The invention is directed to an applicator for coating a traveling fiber web with a coating mixture. The applicator includes a backing roll having a shell surface for carrying the web, and a nozzle for feeding the coating mixture. The applicator includes a support beam; a nozzle which is integral with or connected to the support beam; and a doctor bar carried by the support beam. The doctor bar has a guide surface. The guide surface and the backing roll define a nip for producing a hydrodynamic pressure. The guide surface approaching the shell surface of the backing roll extends to an exit edge at a location nearest the backing roll. A device is provided for flexibly backing the doctor bar on the support beam.

9 Claims, 3 Drawing Sheets

APPLICATOR FOR COATING A TRAVELING FIBER WEB

BACKGROUND OF THE INVENTION

The present invention relates to an applicator for coating webs of paper or cardboard.

Such an applicator is known from the German patent document DE 43 30 241.

SUMMARY OF THE INVENTION

The present invention relates to a nozzle-equipped applicator that offers the advantages of the previously customary roll applicators using a so-called scoop roll. Retained was the hydrodynamic pressure progression in the nip that is characteristic of the scoop roll applicator, by arrangement of a fixed doctor bar with a guide surface facing toward the web being treated. The pressure impulse created thereby between the paper web and the doctor bar results in a pressurized penetration of the size, respectively sizing water, in the paper in the nip.

The present invention provides an applicator with more sensitive dosing of the sizing and a better pre-wetting in the nip than heretofore were achieved, and that film splitting is avoided.

It has been recognized that a consistent coating application is achievable, irrespective of variations in web thickness and/or the respective consistency or viscosity of the size, by a flexible backing of the doctor bar arranged on the applicator support beam and by profiling it (control of line pressure in the nip). This makes the nip easily variable and adaptable to the hydrodynamic pressure, so that it is not necessary to move for that purpose the entire supporting beam by means of hydraulic power elements toward the backing roll, such as is the case with the prior art.

The invention comprises, in one form thereof, an applicator for coating a traveling fiber web with a coating mixture. The applicator includes a backing roll having a shell surface for carrying the web, and a nozzle for feeding the coating mixture. The applicator includes a support beam; a nozzle which is integral with or connected to the support beam; and a doctor bar carried by the support beam. The doctor bar has a guide surface. The guide surface and the backing roll define a nip for producing a hydrodynamic pressure. The guide surface approaching the shell surface of the backing roll extends to an exit edge at a location nearest the backing roll. A device is provided for flexibly backing the doctor bar on the support beam.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF TEE INVENTION

Figure 1:
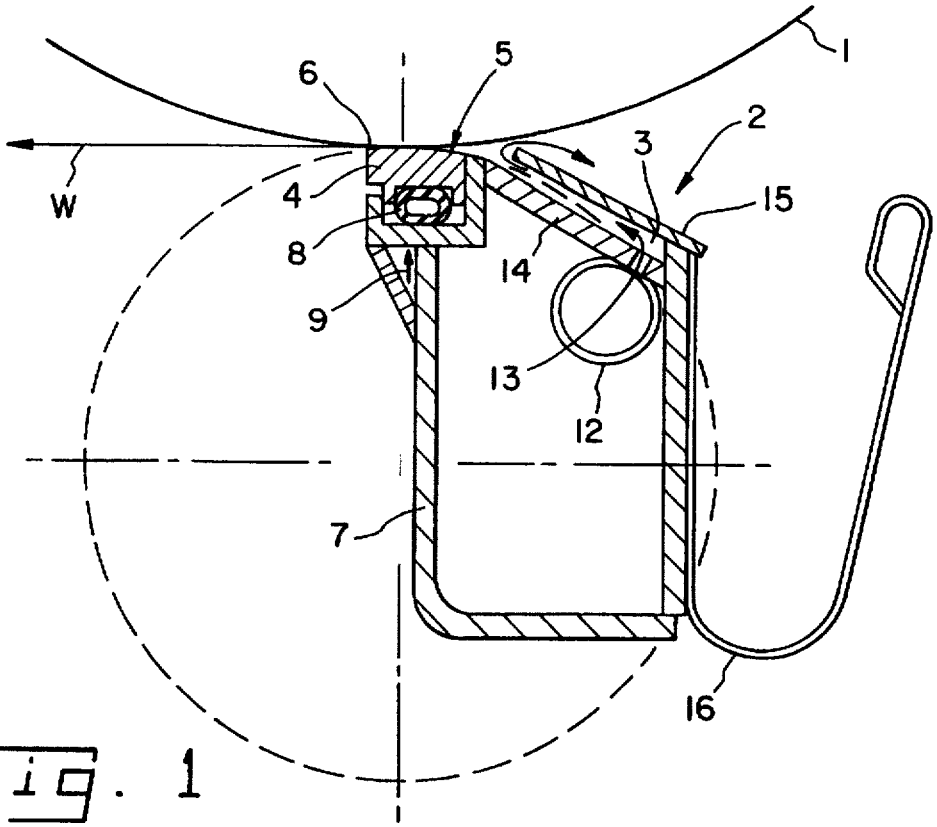
FIG. 1 is an overall arrangement of an embodiment of an applicator according to the present invention.

Referring now to the drawings and particularly to FIG. 1, there is shown a backing roll carrying the web W, while 2 is a nozzle with a channel 3, and 4 indicates a doctor bar forming the nip and featuring a guide surface 5. Doctor bar 4 has an exit edge 6, which may be fashioned both sharp-edged or with a slight radius.

Figure 2:
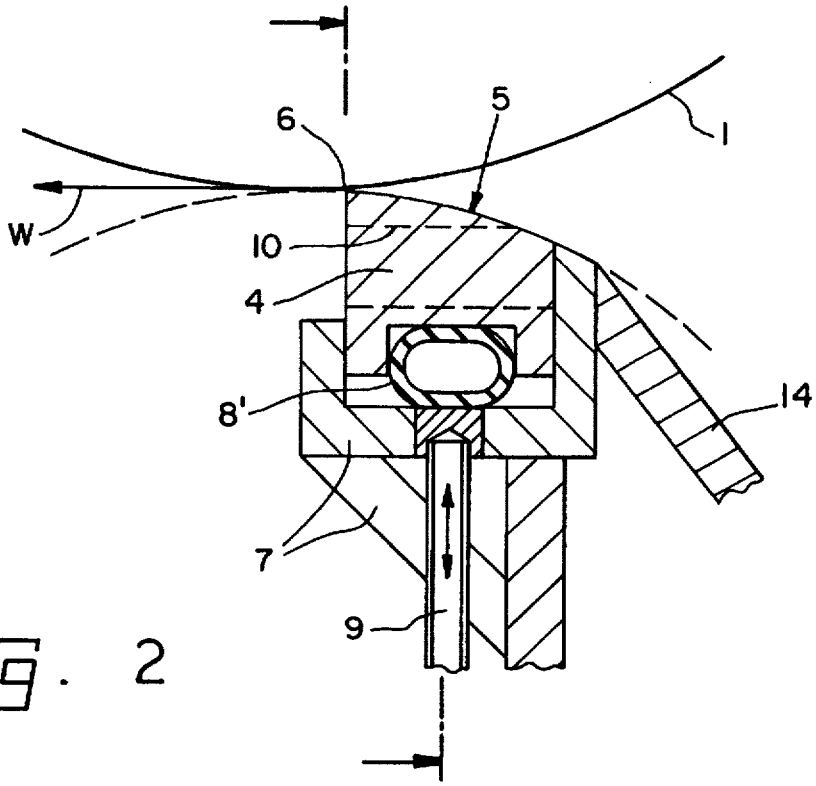
FIG. 2 is an enlarged illustration of the doctor bar shown in FIG. 1.

Doctor bar 4 is arranged on and bears flexibly on a support beam 7. The backing is effected either by one or several spring elements 8 (as visible in FIG. 4) or by a pressure hose 8'. Using prior adjustment devices 9 (e.g., regulating screws) as illustrated in FIG. 2, the doctor bar can be profiled zonewise toward the backing roll in a radial direction. Of course, pressure hose 8' may also be subdivided across its entire length in individual pressure chambers. These can be acted upon individually and are then effective in the area of application of adjustment devices 9.

Figure 3:
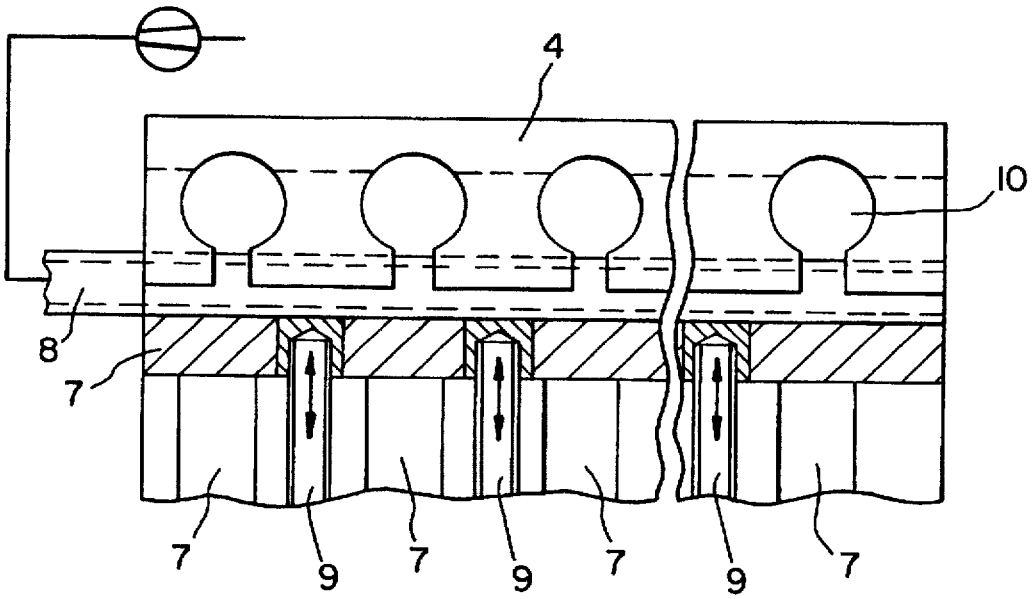
FIG. 3 is a side elevation of FIG. 2.

Especially favorable is providing doctor bar 4 with hollow cavities 10 which are distributed across its entire length (illustrated in FIG. 3). Doctor bar 4 thereby assumes only a slight geometric moment of inertia, whereby a flexibility desirable for the profiling is achieved. This flexibility can alternatively be accomplished also by suitable material selection.

In order for doctor bar 4 to obtain a relatively wear-resistant surface, it may be chrome-plated or provided with a ceramic coating.

Adjustment devices 9 are arranged the simplest in the area between the recesses 10 and cross braces of the support beam 7.

The profiling and flexible backing of doctor bar 4 allows adjustment of the nip width on the exit edge 6 of the doctor bar 4 and control of the hydrodynamic pressure progression, due to the modified nip form.

Figure 5:
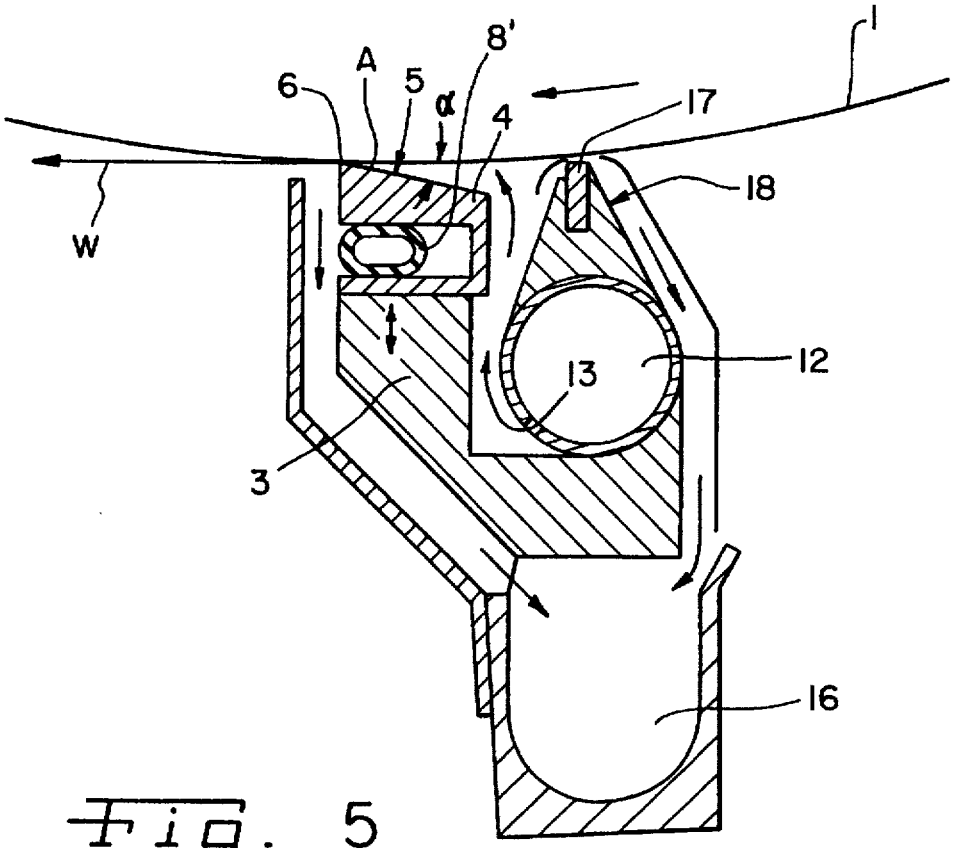
FIG. 5 is a further embodiment of the backing and flexibility of the doctor bar.
Figure 6:
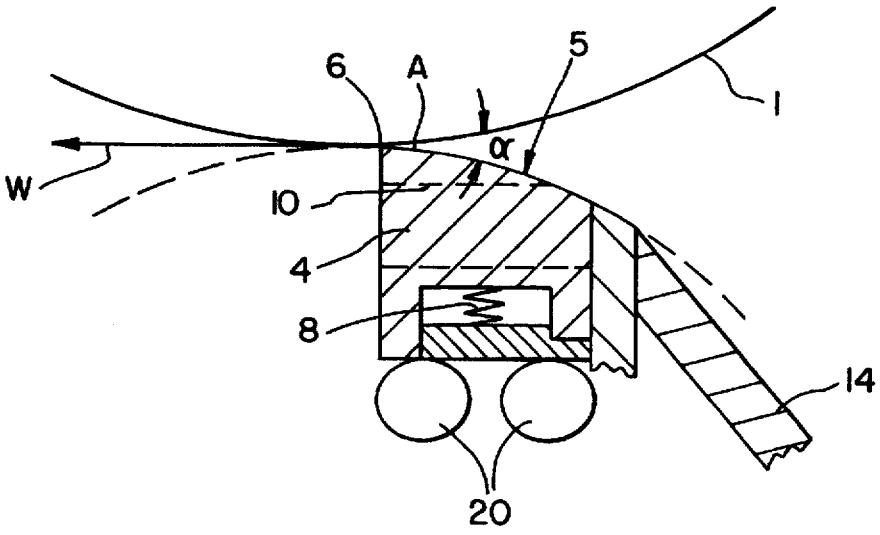
FIG. 6 is a further embodiment of the backing and flexibility of the doctor bar.

Possible in a favorable manner is even a modification of the approach angle of the nip A, by means of a one-sidedly arranged pressure hose 8'—refer to FIG. 5—or by means of eccentric elements 20—FIG. 6. Both eccentric elements 20 are adjustable independently of each other, so that doctor bar 4, also with this embodiment variant according to FIG. 6 as well as the variant according to FIG. 5, is tiltable and allows thereby a very sensitive angular adjustment.

FIG. 1 illustrates the channel 3 of the nozzle 2 with a width decreasing toward its discharge end, but it may also have a constant width. Sizing feeding to the nozzle channel takes place by way of a manifold pipe 12 which, the same as the other illustrated components, extends across the entire length relative to backing roll 1. Manifold pipe 12 features sizing discharge bores 13 distributed across its length. A wall 14 of the nozzle channel 11 is integrated into the support beam 7. The other bounding wall 15 may be pivotally fitted on the support beam (the pivotal connection is not illustrated in the drawings).

Figure 4:
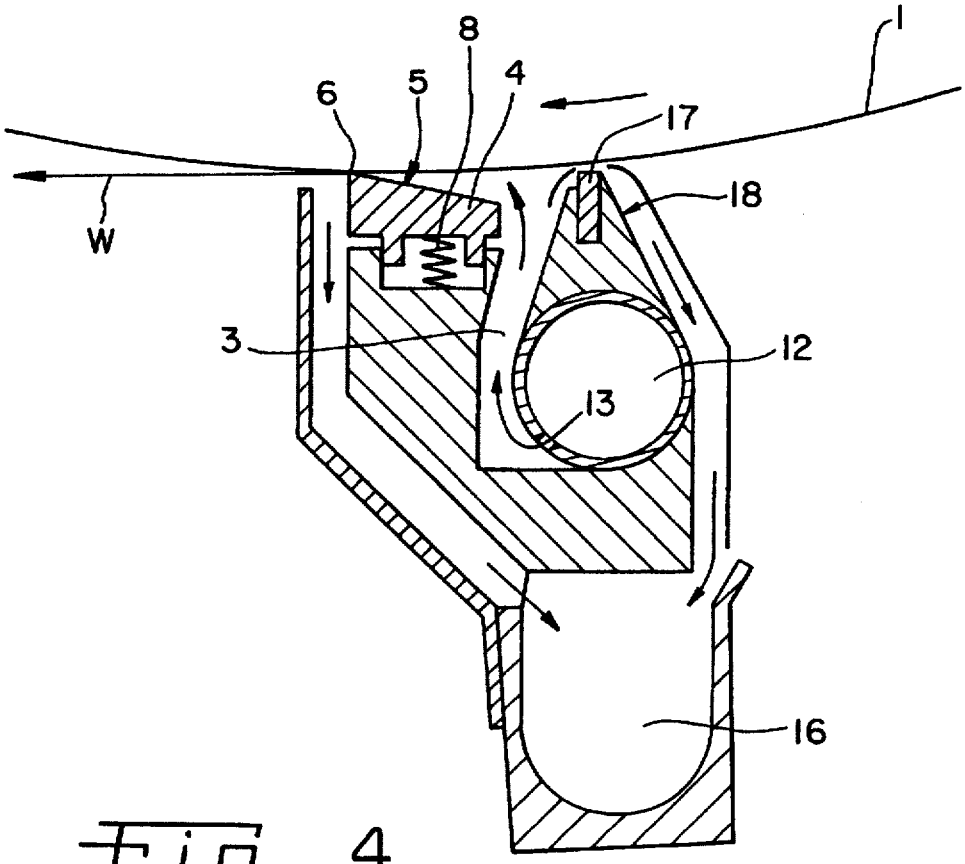
FIG. 4 is a second embodiment of an applicator according to the present invention.

Surplus sizing escaping at the end of the nozzle channel opposite to the direction of web travel is collected by a tub 16 (FIGS. 4 and 5). As can be seen from another embodiment shown in FIG. 4, surplus sizing run-off from the exit edge 6 can be collected as well in tub 16. Surplus sizing escaping from the nozzle channel 3 opposite to the direction of web travel flows in this embodiment across an overflow edge 17 and, following a run-off surface 18, flows as well into the tub 16.

The applicator illustrated in FIGS. 1 and 4 may be a predosing device. In such a case, a subsequent afterdosing device is typically provided on backing roll 1 with which the sizing is doctored to the desired thickness. This dosing device is not shown in FIGS. 1 and 4.

The applicator described above, according to FIGS. 1 and 4, may also be an afterdosing or finish dosing device itself, wherein the finish dosing can be realized very well, due to the flexible backing and the flexibility of doctor bar 4.

In prior applicators, a flexural compensation system is integrated in or on the support beam. Owing to the flexible backing of the doctor bar with pressure hose 8, the hose 8 can likewise serve the function of flexural compensation, so that with the present invention a flexural compensation system in the support beam is dispensable, representing a further advantage of the invention.

Doctor bar 4 may have a flat, convex or concave guide surface 5. In FIG. 1, the scoop roll used in the case of the prior art is indicated by a dashed circle. This means that the convex guide surface 5 illustrated in FIGS. 1, 2 and 4 may have approximately the same radius as the original scoop roll. The length of the guide surface up to exit edge 6 is 25 to 120 mm. A length between 50 and 80 mm has been shown to be particularly favorable and it creates an optimum nip.

The applicator according to the present invention is suited equally well for direct application (sizing application directly on the paper web) or indirect application. In the latter case, as is generally known, the sizing is applied on a transfer medium, for example an applicator roll, and subsequently picked up by the paper web.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator for coating a traveling fiber web with a coating mixture, said applicator comprising:

a backing roll having an outside surface for carrying the web;

a support beam;

a nozzle for feeding the coating mixture, said nozzle being one of integral with and connected to said support beam;

a doctor bar carried by said support beam, said doctor bar having a guide surface, said guide surface approaching said outside surface of the backing roll defining a converging nip with the backing roll for receiving the coating mixture from said nozzle and producing a hydrodynamic pressure, said guide surface extending to an exit edge at a location nearest the backing roll, said doctor bar allowing zonewise profiling of the coating mixture in a radial direction relative to the backing roll; and means for flexibly backing said doctor bar on said support beam, said backing means flexibly backing said doctor bar such that an entrance angle of said nip is variable.

2. An applicator for coating a traveling fiber web with a coating mixture, said applicator comprising:

a backing roll having an outside surface for carrying the web;

a support beam;

a nozzle for feeding the coating mixture, said nozzle being one of integral with and connected to said support beam;

a doctor bar carried by said support beam, said doctor bar having a guide surface, said guide surface approaching said outside surface of the backing roll defining a converging nip with the backing roll for receiving the coating mixture from said nozzle and producing a hydrodynamic pressure, said guide surface extending to an exit edge at a location nearest the backing roll, said doctor bar allowing zonewise profiling of the coating mixture in a radial direction relative to the backing roll and means for flexibly backing said doctor bar on said support beam.

3. The applicator according to claim 2, wherein said backing means comprises at least one of:

at least one spring element;

a pressure hose; and at least one eccentric element.

4. The applicator according to claim 2, wherein said doctor bar includes a plurality of hollow cavities extending through said doctor bar and distributed across a length thereof.

5. The applicator according to claim 3, wherein said guide surface of said doctor bar is one of flat, convex, and concave.

6. The applicator according to claim 2, wherein said guide surface has a length up to said exit edge, measured in a direction of web travel, which amounts to between 35 and 120 mm.

7. The applicator according to claim 6, wherein said guide surface has a length up to said exit edge, measured in the direction of web travel, which amounts to between 50 and 80 mm.

8. The applicator according to claim 2, wherein said doctor bar includes a wear-resistant coating.

9. The applicator according to claim 8, wherein said wear-resistant coating comprises one of a chrome and ceramic coating.

* * * * *